United States Patent [19]

Sakamoto

[11] Patent Number: 5,028,748

[45] Date of Patent: Jul. 2, 1991

[54] LIMIT SWITCH

[75] Inventor: Kunio Sakamoto, Tottori, Japan

[73] Assignee: Omron Corporation, Kyoto, Japan

[21] Appl. No.: 499,609

[22] Filed: Mar. 27, 1990

[30] Foreign Application Priority Data

| | | | |
|---|---|---|---|
| Mar. 28, 1989 | [JP] | Japan | 1-35358[U] |
| Mar. 28, 1989 | [JP] | Japan | 1-35359[U] |
| Mar. 28, 1989 | [JP] | Japan | 1-35360[U] |
| Oct. 17, 1989 | [JP] | Japan | 1-269478 |

[51] Int. Cl.[5] ..... H01H 3/16; H01H 3/20

[52] U.S. Cl. ..... 200/047; 200/332.00

[58] Field of Search ..... 200/47, 332, 337, 338

[56] References Cited

U.S. PATENT DOCUMENTS 4,847,453 7/1989 Newell et al. ..... 200/47

*Primary Examiner*—Henry J. Recla
*Assistant Examiner*—David J. Walczak
*Attorney, Agent, or Firm*—Fish & Richarson

[57] ABSTRACT

A limit switch comprising a case housing a switching unit, a head secured to one end of the case, a rotary shaft rotatably supported by the head and having a flat portion, a manipulation lever secured at a butt end thereof to the rotary shaft which supports at a tip end thereof roller means for detecting an object, a return coil spring provided in the head which applies a force through a return plunger to the flat portion of the rotary shaft to return the manipulation lever to a free position, a disk cam secured to the rotary shaft and having a projection formed on a peripheral portion thereof in a position corresponding to the free position of the manipulation lever, manipulation plunger means for the switching unit which is driven in response to rotary movement of disk cam and elastic stopper means disposed in the head for contacting the projection of disk cam and for braking the manipulation lever when manipulation lever is returned to the free position, whereby the lever is prevented from being swung back beyond the free position. Therefore, the switching unit is prevented from chattering.

5 Claims, 17 Drawing Sheets

LIMIT SWITCH

TECHNICAL FIELD OF THE INVENTION

The present invention relates to a limit switch for various kinds of production equipment, industrial robots and so forth, and particularly relates to a limit switch which detects an object by means of a manipulation lever rotatably supported by the head of the switch.

DESCRIPTION OF THE RELATED ART

Limit switches in general comprise a case housing, a basic switching mechanism having a manipulation rod of the pushed-in type, a head housing a cam for converting a rotating motion into a straight motion, and a manipulation lever pivotally coupled to the head. When the manipulation lever is rotated to an operative position against the force of a return spring by a detected object such as a workpiece, the cam acts to convert the rotation of a rotary shaft associated with the manipulation lever, into straight motion of a plunger supported by the case or the head, so that the manipulation rod of the basic switching mechanism is pushed in by the plunger. Since the manipulation lever receives the force of the return spring when the lever is rotated back to the free position thereof, the lever is likely to be rotated back beyond the free position. Since the force of the return spring for the manipulation lever is stronger than that of a spring for returning the manipulation rod of the basic switching mechanism, the rod is pushed in to generate an inversion signal if the lever is rotated back beyond the free position. This generation of an erroneous inversion signal is a problem.

FIGS. 1 and 2 shown a limit switch which is relavent to the present invention. The limit switch includes a case 1, a basic switching mechanism 2 housed in the case, and a head 3 secured to the upper end of the case. A rotary shaft 4 is rotatably supported by bearings 5 and 6 in the head 3, and projects out of the cylindrical portion 3*a* of the head at one end of the shaft. The butt a of a manipulation lever 7 for detecting an object is secured to the rotary shaft 4 at the above-mentioned end thereof. A roller 8 is rotatably supported by a shaft 9 at the tip 7*b* of the manipulation lever 7. The opening of the cylindrical portion 3*a* of the head 3 is closed with a seal plate 10. An oil seal 11 is interposed between the rotary shaft 4 and the cylindrical portion 3*a* of the head 3. An annular groove 12 is provided in the outside circumferential surface of the rotary shaft 4. An O-ring 13 is fitted in the annular groove 12. The rotary shaft 4 has a flat portion 14, on the top of which a return plunger 15 shaped as a bottomed cylinder is provided. A return coil spring 16 is engaged between the return plunger 15 and the inside surface of the upper portion of the head 3 so that a returning force is applied to the flat portion 14 of the rotary shaft 4 through the return plunger by the spring. A fixed plate 17 is fitted in the lower portion of the head 3. A manipulation plunger 20, which is driven by a disk cam 19 secured to the rotary shaft 4, is fitted in the center hole 18 of the fixed plate 17 so that the plunger is movable in the axial direction thereof. A lever 21 is supported by a shaft 22 in the case 1 so that the lever is rotatable and the tip of the lever is in contact with the manipulation rod 23 of the basic switching mechanism 2. The central portion of the lever 21 has a projection 21*b*, which is pushed in by the manipulation plunger 20. An O-ring 24 is provided between the mutually fitted portions of the case 1 and the head 3. A name plate 25 is attached to the outside of the case 1. A terminal box 26 housing terminals 27 is attached to the case 1. A screw 28 for attaching the basic switching mechanism 2 is tightened thereon. An E-shaped washer 29 for securing the disk cam 19 is provided.

The operation of the limit switch is now described in detail. When the object has come into contact with the roller 8, the rotary shaft 4 is rotated against the force of the return coil spring 16. As a result, the disk cam 19 is turned so that the manipulation plunger 20 is moved down following the surface of the cam. The projection 21*b* of the lever 21 is pushed in due to the above-mentioned downward movement of the plunger 20 so that the lever is rotated counterclockwise about the shaft 22 with regard to FIG. 2. Accordingly, the manipulation rod 23 of the basic switching mechanism 2 is pushed in by the tip 21*a* of the lever 21 so that the mechanism is turned on. When the object thus breaks contact with the roller 8, the rotary shaft 4 is rotated back to the original position thereof by the force of the return coil spring 16. As a result, the manipulation rod 23 of the basic switching mechanism 2 is moved back to the original position thereof so that the mechanism is turned off.

Since the rotary shaft 4 is rotated back to the original position thereof by the force of the return coil spring 16, the manipulation lever 7 is likely to be rotated back beyond the free position thereof due to the inertial force thereof so as to cause the basic switching mechanism 2 to chatter. This is a problem. In addition, since the flat portion 14 of the rotary shaft 4 and the return plunger 15 collide with each other when the manipulation lever 7 is rotated back to the free position thereof, the edge of the flat portion or the like is likely to be worn. This is another problem.

SUMMARY OF THE INVENTION

The present invention was made in order to solve the above-mentioned problems.

Accordingly, it is an object of the present invention to provide a limit switch in which a manipulation lever is prevented from being moved back to the free position. In the limit switch according to one embodiment of the invention, a head supporting a rotary shaft is secured to one end of a case housing a switching unit. The butt of the manipulation lever, which supports a roller at the tip of the lever so as to detect an object, is secured to the rotary shaft. A return coil spring, whose force is applied radially to a flat portion of the rotary shaft by means of a movable plunger is provided in the head. A disk cam, by which a manipulation plunger for turning on or off the switching unit is driven in response to the operation of the manipulation lever, is secured to the rotary shaft. The peripheral portion of the disk cam has a projection in a position corresponding to the free position of the manipulation lever, and an elastic stopper means is provided in the head so that when the manipulation lever is rotated back to the free position, the projection comes into contact with the stopper means to brake the lever. Since the manipulation lever is braked by the cooperation between the projection of the peripheral portion of the disk cam and the elastic stopper means when the lever is rotated back to the free position thereof, the lever is prevented from being rotated back beyond the free position. For that reason, the switching unit is prevented from chattering.

In the limit switch according to another embodiment of the invention, a rotary shaft is supported by a head secured to one end of a case. The butt of the manipulation lever, which supports a roller at the tip of the lever so as to detect an object, is secured to the rotary shaft. A return coil spring, whose force is applied to a flat portion of the rotary shaft by means of a return plunger, is provided in the head. A sealed space, which surrounds a portion of the rotary shaft, is defined in the head and a plurality of movable plates and a plurality of fixed plates are provided in the sealed space and attached to the peripheral surface of the rotary shaft and the inside surface of the head, respectively, in such a manner that the plates are alternately disposed along the axis of the rotary shaft. A viscous fluid is hermetically contained in the sealed space. Before the manipulation lever is rotated back to the free position thereof, the inertial force of the lever is absorbed by the movable and the fixed plates together with the viscous fluid in the sealed space of the head so that the operation of the limit switch is made appropriated.

In the limit switch according to a further embodiment of the invention, a rotary shaft is supported by a head secured to one end of a case. The butt of the manipulation lever, which supports a roller at the tip of the lever so as to detect an object, is secured to the rotary shaft. A return coil spring, whose force is applied to a flat portion of the rotary shaft by means of a return plunger, is provided in the head. The surface of the flat portion of the rotary shaft, with which the return plunger comes into contact, is provided with an elastic plate for absorbing the impact of the plunger on the flat portion when the manipulation lever is rotated back to the free position. Before the manipulation lever is rotated back to the free position thereof, the return plunger comes into contact with the elastic plate provided on the flat portion of the rotary shaft so that the inertial force of the lever is absorbed. Therefore, chattering is avoided and the plunger is prevented from colliding against the flat portion of the rotary shaft.

The limit switch according to still another embodiment of the invention comprises, a case housing a basic switching mechanism having a manipulation rod of the pushed-in type and a head attached to one end of the case. The manipulation lever is supported by the head so that the lever is rotatable and a cam is provided on a rotary shaft for the manipulation lever so as to convert a rotating motion into a straight motion. The switch also includes a return spring for applying a returning force to the manipulation lever through the cam and the rotary shaft, a plunger provided in the case or the head so as to turn on or off the basic switching mechanism in response to the cam, and a drive lever provided between the cam and the manipulation rod of the basic switching mechanism so that the drive lever counteracts the driving force of the cam to the manipulation rod when the manipulation lever is one the verge of being rotated back beyond the free position. When the manipulation lever is on the verge of being rotated back beyond the free position by the force of the return spring, the drive lever provided between the cam and the manipulation rod of the basic switching mechanism counteracts the driving force of the cam to the manipulation rod because of the leverage of the drive lever ( which is the ratio of the length from the fulcrum for the drive lever to the point of application of over the length from the fulcrum to the point of action of the lever) so that the manipulation rod is prevented from being pushed in. For that reason, the inversion signal is prevented from being generated.

DETAILED DESCRIPTION OF THE EMBODIMENTS

Embodiments of the present invention to be described hereinbelow provides advantages over the foregoing structure.

Figure 3:
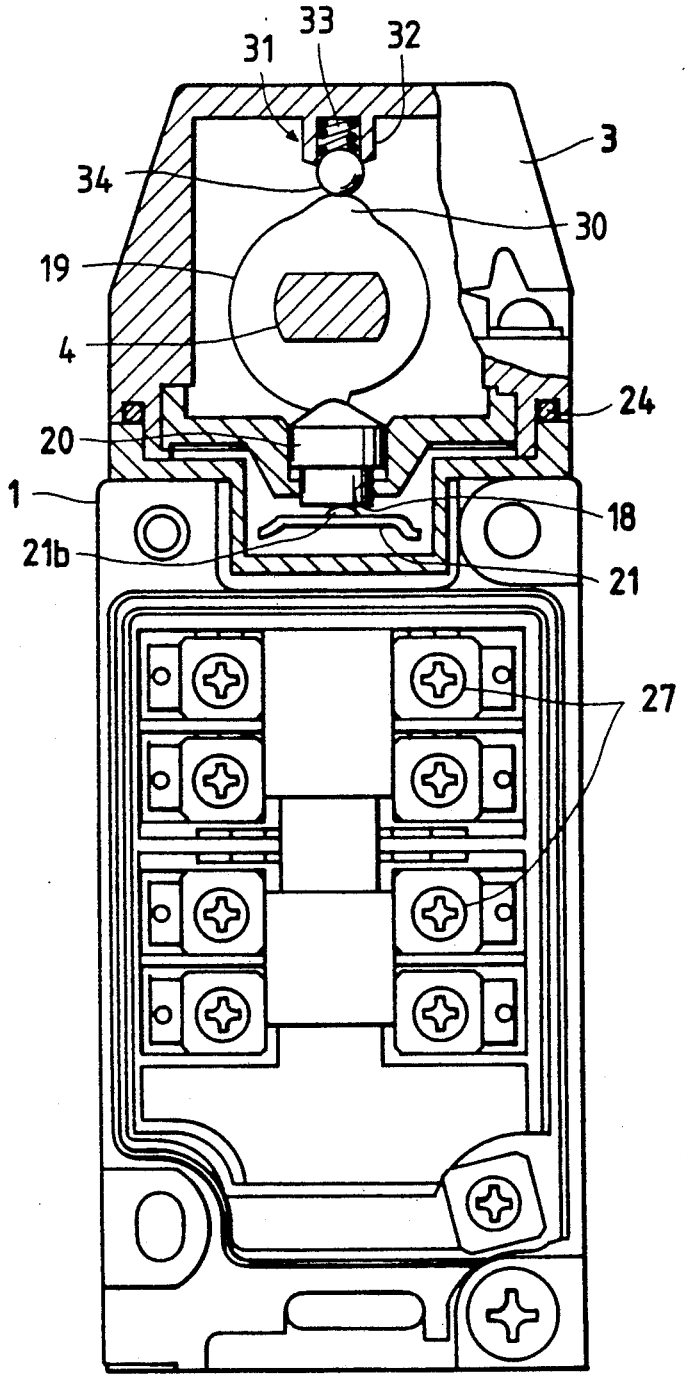
FIG. 3 is a cutaway front view of a limit switch according to an embodiment of the present invention.
Figure 4:
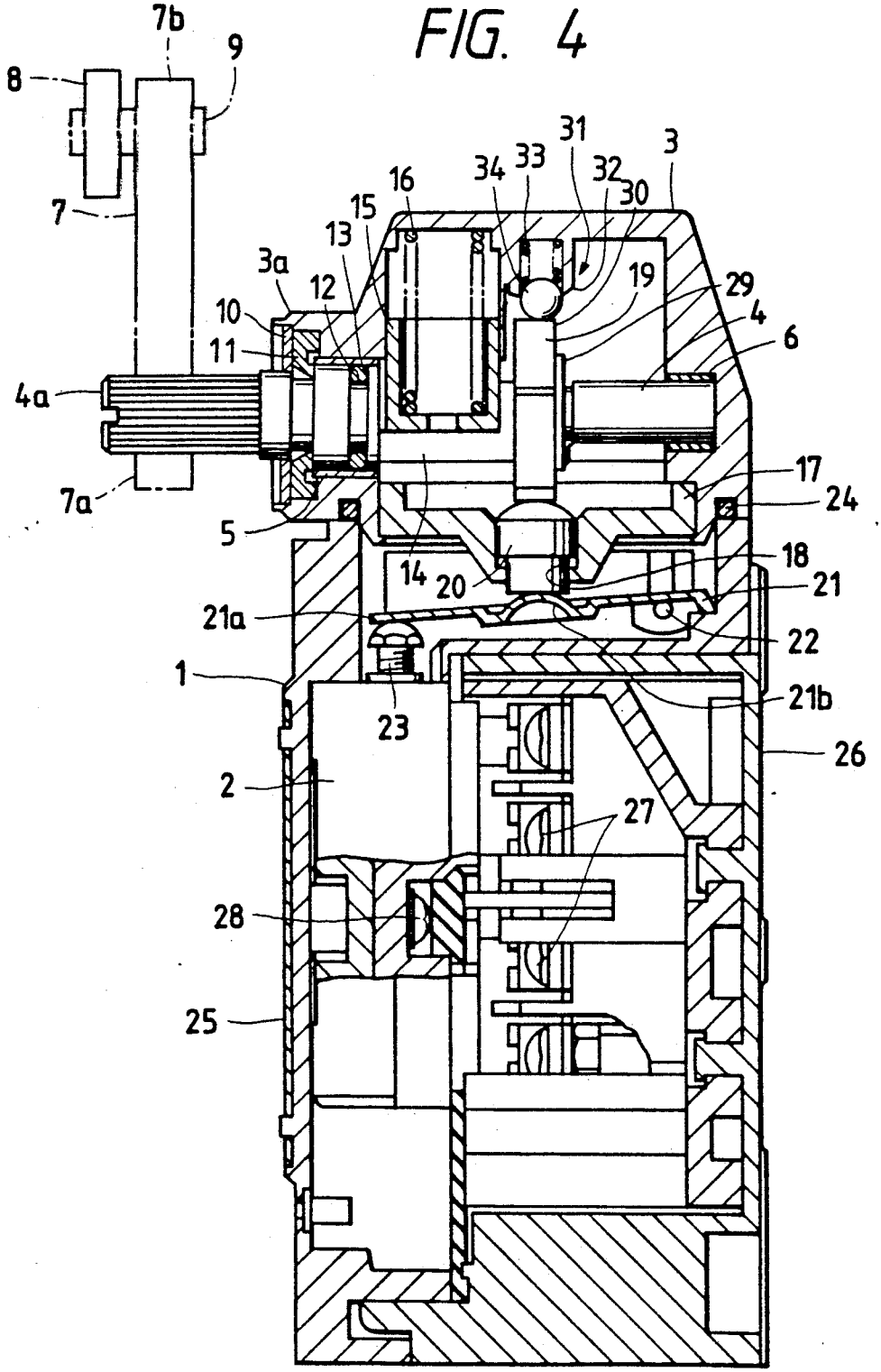
FIG. 4 is a cutaway side view of the limit switch shown in FIG. 3.
Figure 5:
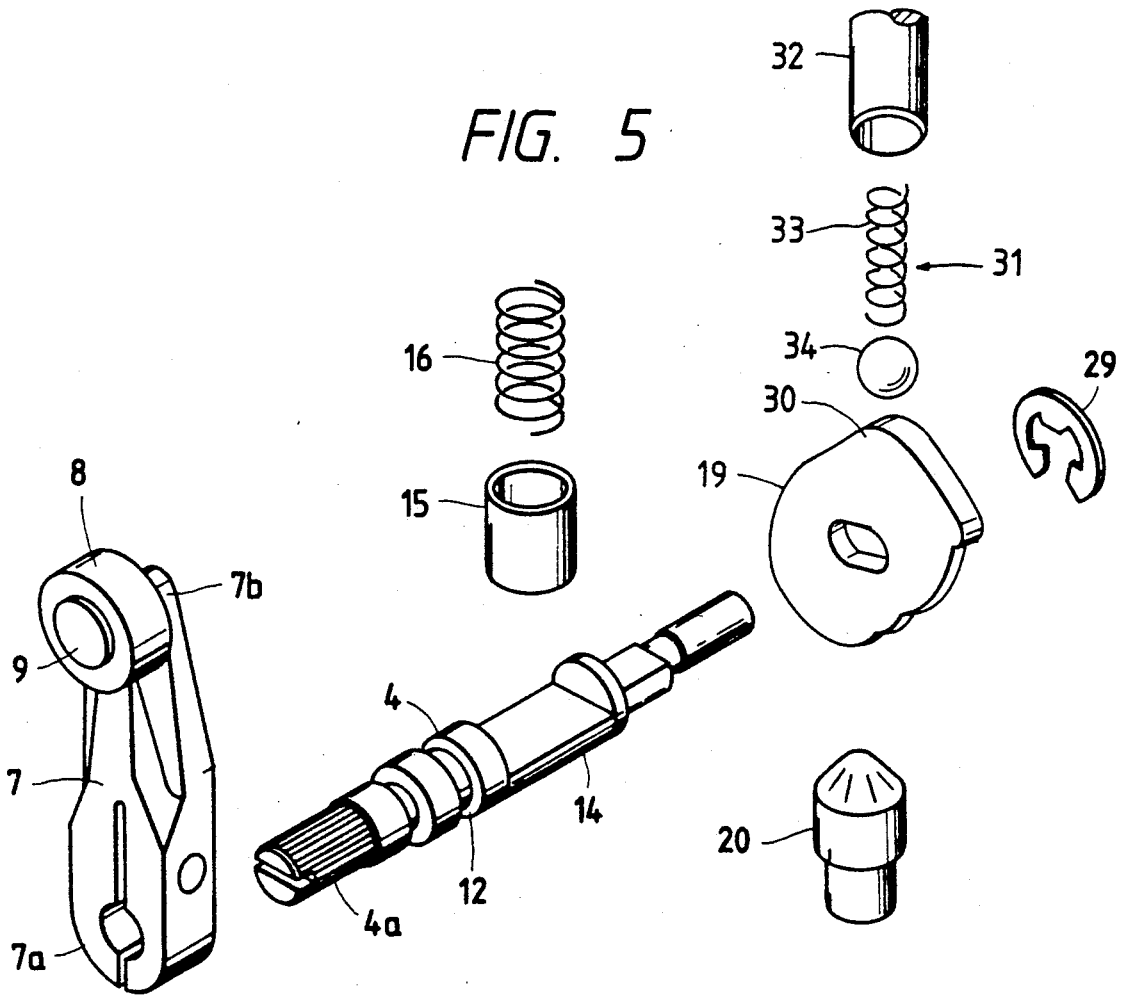
FIG. 5 is a perspective exploded view of a major part of the limit switch shown in FIG. 3.

FIG. 3 is a cutaway front view of a limit switch which is one of the embodiments. FIG. 4 is a cutaway side view of the limit switch. FIG. 5 is an exploded view of a major part of the limit switch. The portions of the limit switch, which correspond to those of the limit switch provided in accordance with the related art, are denoted by the same reference symbols and are not described in detail hereinafter. The peripheral portion of the disk cam 19 of the limit switch shown in FIGS. 3 and 4 has a projection 30 in a position corresponding to the free position of the manipulation lever 7 of the switch. The elastic stopper means 31 of the limit switch is provided in the head 3 thereof, and includes a guide cylinder 32 extending down from the inside surface of the head, a compressed spring 33 fitted in the guide cylinder, and a steel ball 34 interposed between the spring and the peripheral surface of the disk cam 19. Before the manipulation lever 7 is rotated back to the free position thereof, the projection 30 comes into contact with the elastic stopper means 31 so that the lever is braked.

The operation of the limit switch is described in detail from now on. The basic operation of the limit switch is the same as that of the operation of the limit switch provided in accordance with the related art, and is thereof not described in detail hereinafter. Once an object which has been detected by the limit switch breaks contact with the roller 8 thereof, the manipulation lever 7 is rotated back to the free position by the force of the return coil spring 16 of the switch. The projection 30 of the disk cam 19 receives a pressure contact force from the steel ball 34 receiving the force of the compressed spring 33, so that the rotary shaft 4 of the limit switch is braked. For that reason, the inertial force of the manipulation lever 7 is absorbed so that the lever is prevented from being rotated back beyond the free position. The basic switching mechanism 2 of the limit switch is thus prevented from chattering and the like.

Figure 6:
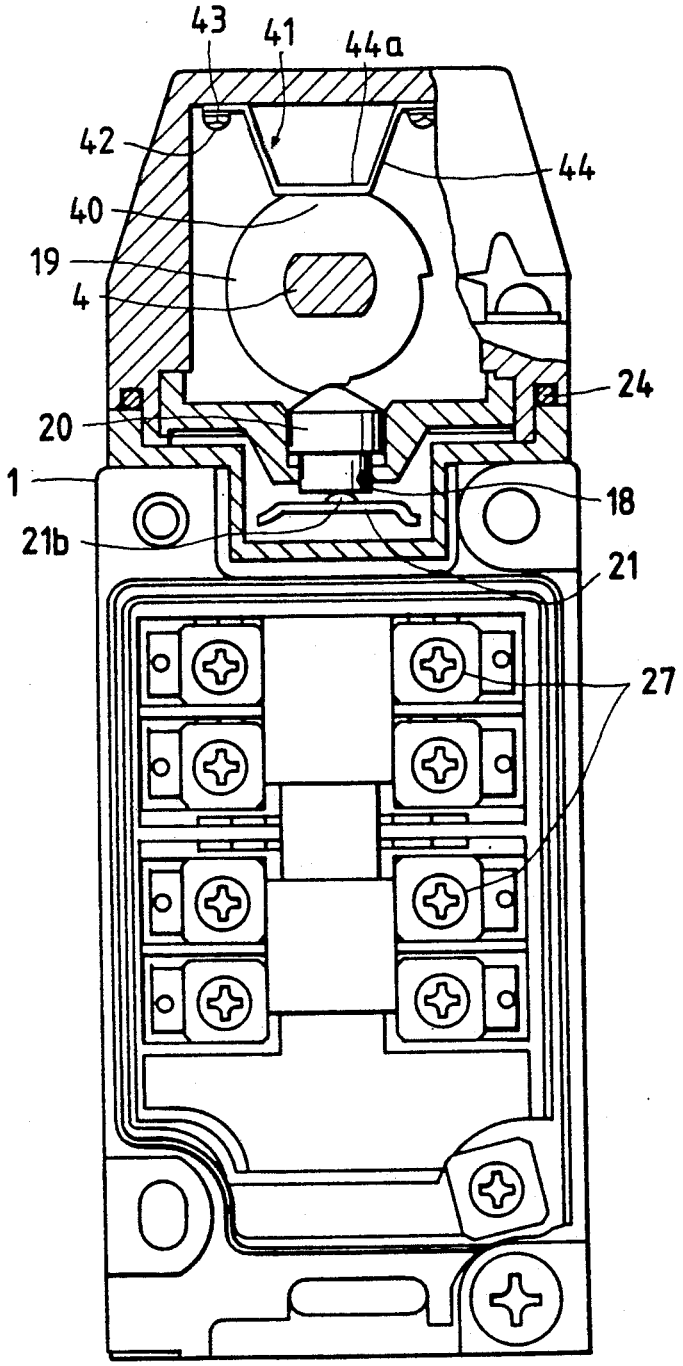
FIG. 6 is a cutaway front view of a limit switch according to another embodiment of the present invention.
Figure 7:
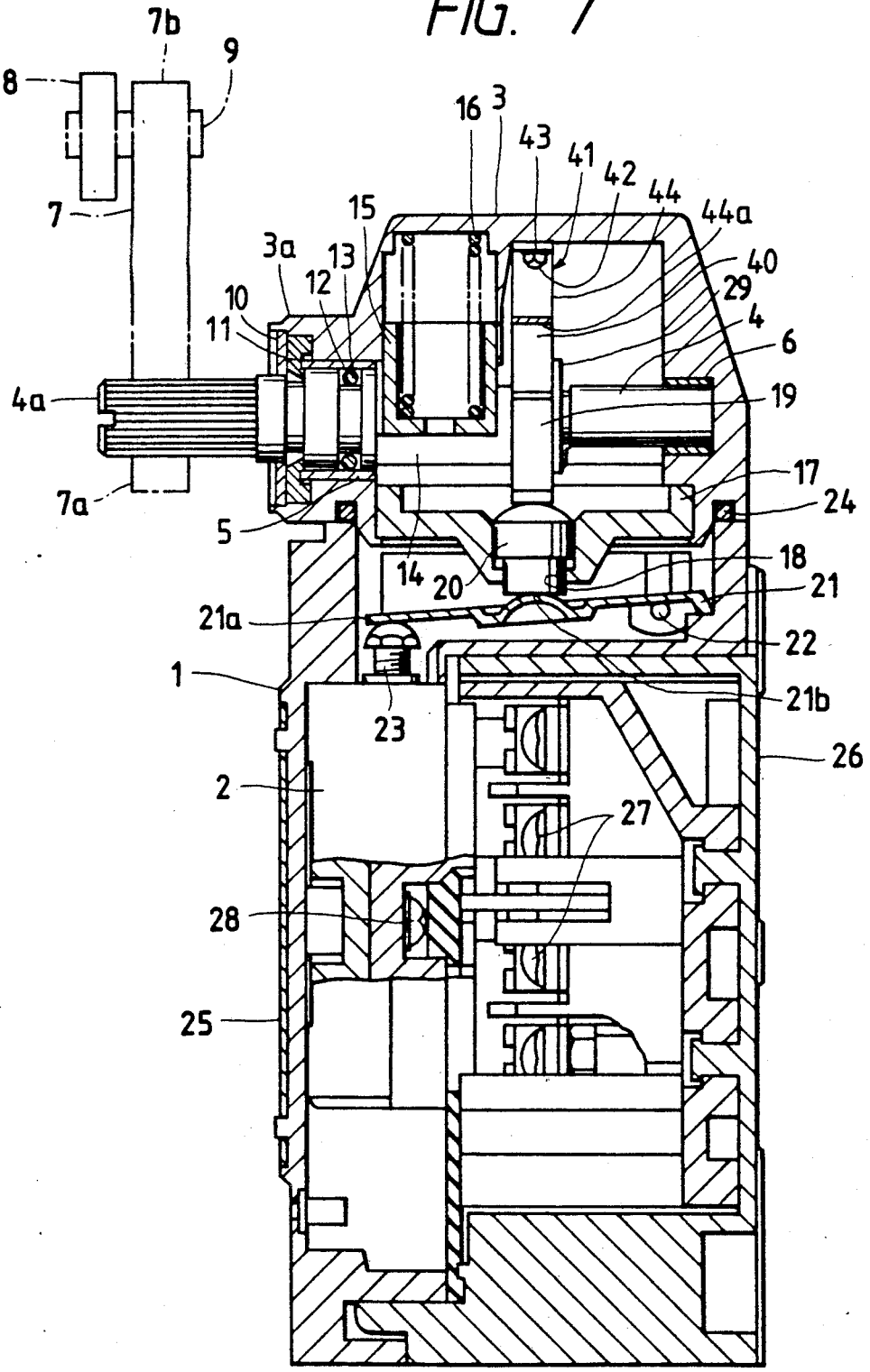
FIG. 7 is a cutaway side view of the limit switch shown in FIG. 6.
Figure 8:
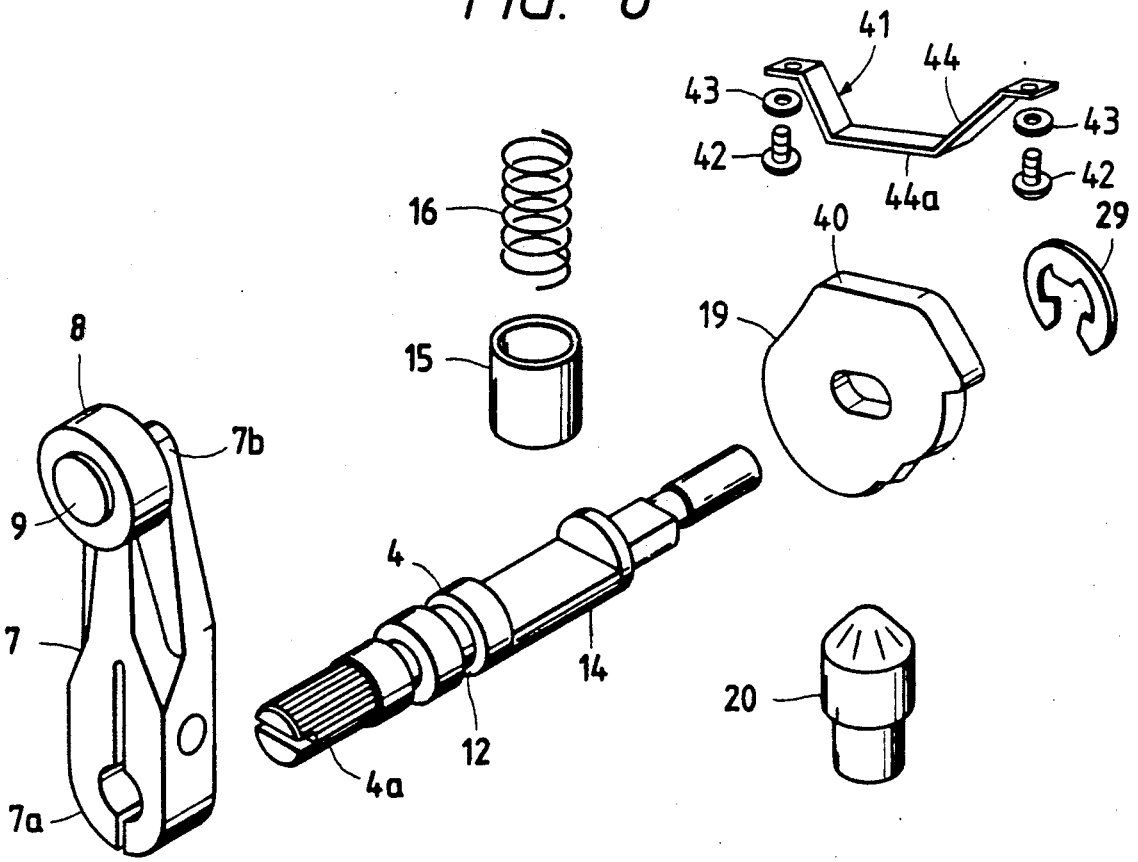
FIG. 8 is a perspective exploded view of a major part of the limit switch shown in FIG. 6.

FIGS. 6, 7 and 8 show a limit switch which is another embodiment. The disk cam 19 of the limit switch has a plateau-like projection 40. The switch includes an elastic stopper means 41 made of a nearly U-shaped plate spring 44 secured to the inside surface of the head 3 of the switch with screws 42 and washers 43 or the like. When the manipulation lever 7 of the limit switch is rotated back to the free position thereof, the projection 40 comes into pressure contact with the central portion 44*a* of the plate spring 44 so that the inertial force of the lever is absorbed. For that reason, the lever 7 is prevented from being rotated back beyond the free position thereof. The basic switching mechanism 2 of the limit switch is thus prevented from chattering or the like.

Figure 9:
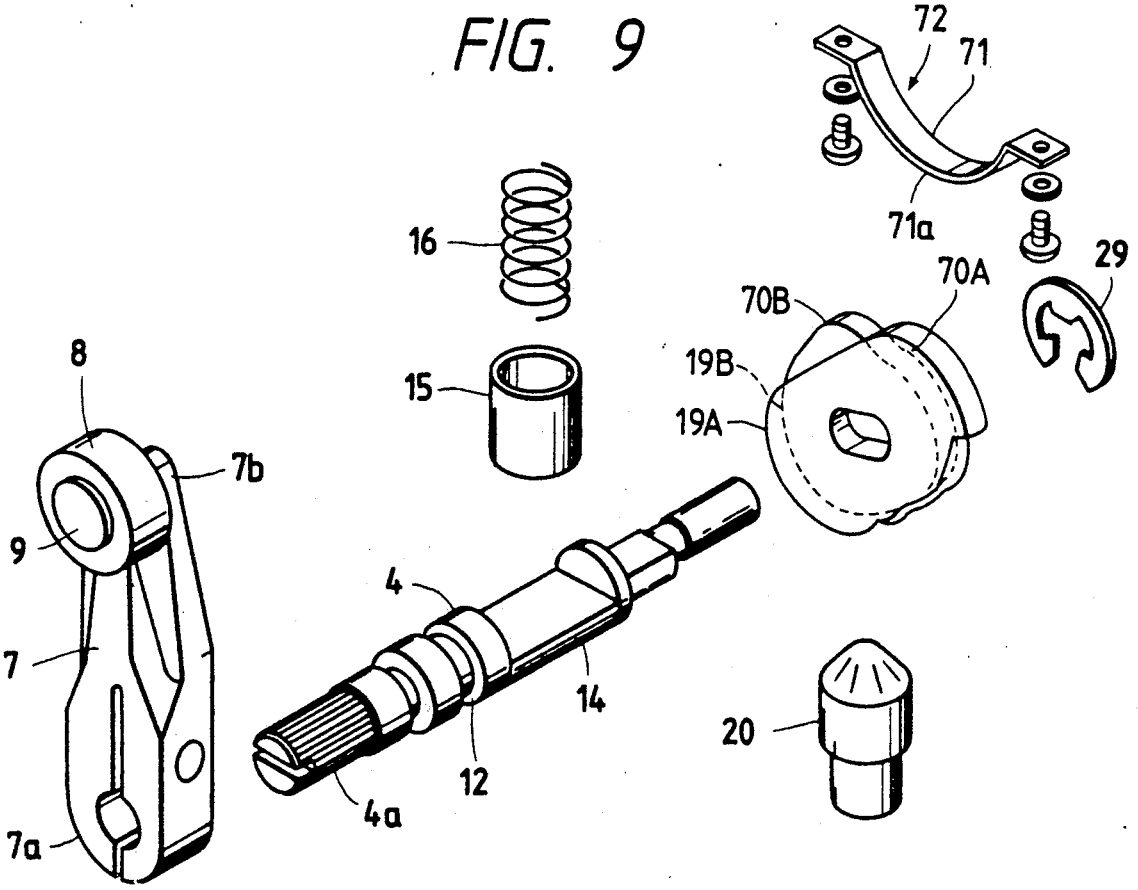
FIG. 9 is a perspective exploded view of a major part of a limit switch according to still another embodiment of the present invention.

FIG. 9 shows a limit switch which is yet another embodiment. The disk cam 19 of the limit switch has two projections 70A and 70B. The switch includes an elastic stopper means 72 made of a curved plate spring 71. The disk cam 19 is pushed between the projections 70A and 70B thereof by the central portion 71*a* of the plate spring 71. The projections 70A and 70B can be formed by joining two cam disks 19A and 19B to each other with a positional difference between them in the circumferential direction thereof, for example. When the manipulation lever 7 of the limit switch is rotated back to the free position thereof, the projections 70A and 70B come into contact with the central portion 71A of the plate spring 71 so that the lever is braked. The inertial force of the lever 7 is thus absorbed so that the lever is prevented from being rotated back beyond the free position thereof. For that reason, the basic switching mechanism of the limit switch is prevented from chattering and the like.

Figure 10:
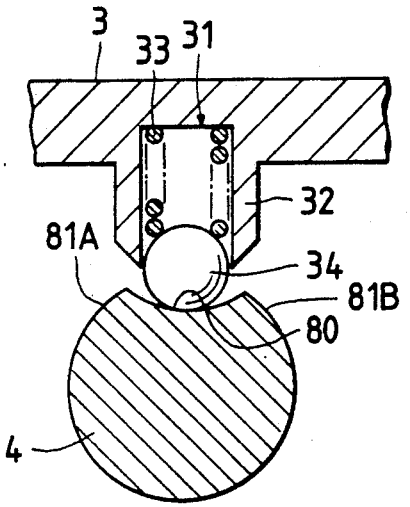
FIG. 10 is a cutaway side view of a modification of a major portion of the limit switch shown in FIG. 9.

Although the disk cam 19 is formed with the peripheral projection 30 or the like in each of the embodiments described above, the present invention can be embodied so that the peripheral portion of the rotary shaft 4 is formed with a notch 80 and projections 81A and 81B, which come into contact with the steel ball 34 or the like, a shown in FIG. 10.

Figure 1:
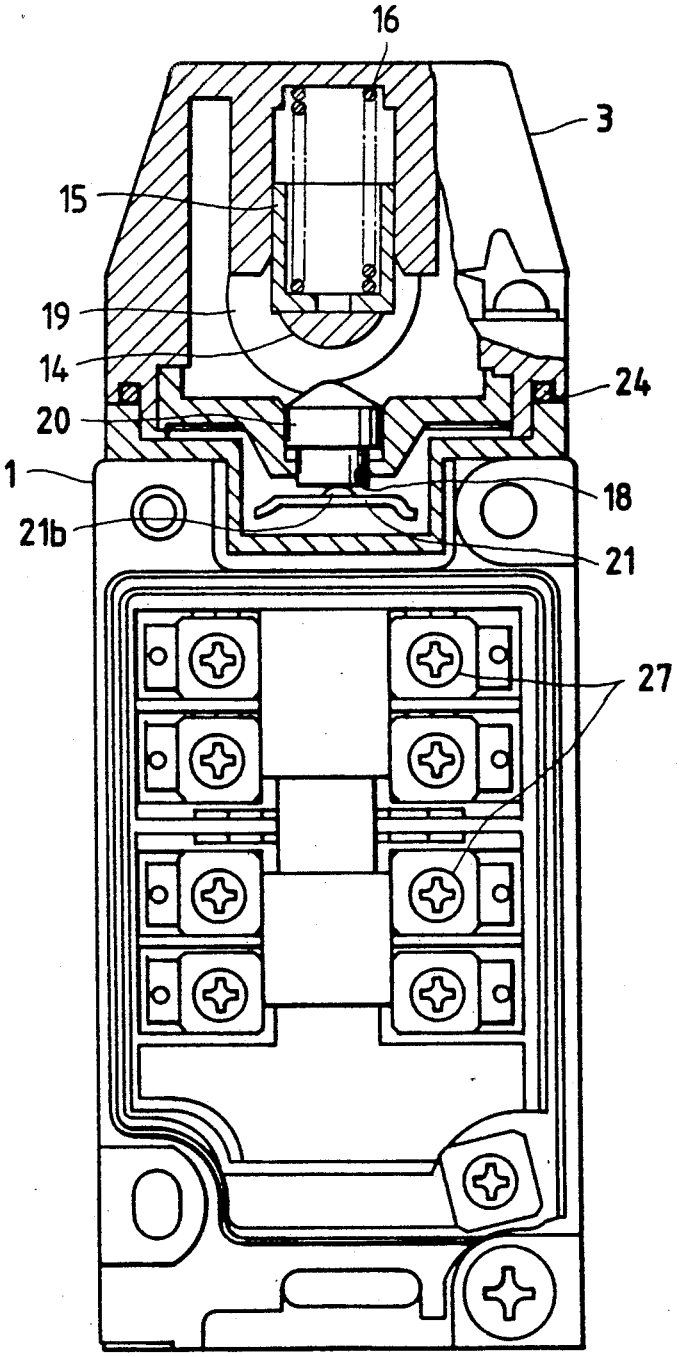
FIG. 1 is a cutaway front view of a limit switch provided in accordance with a related art.
Figure 2:
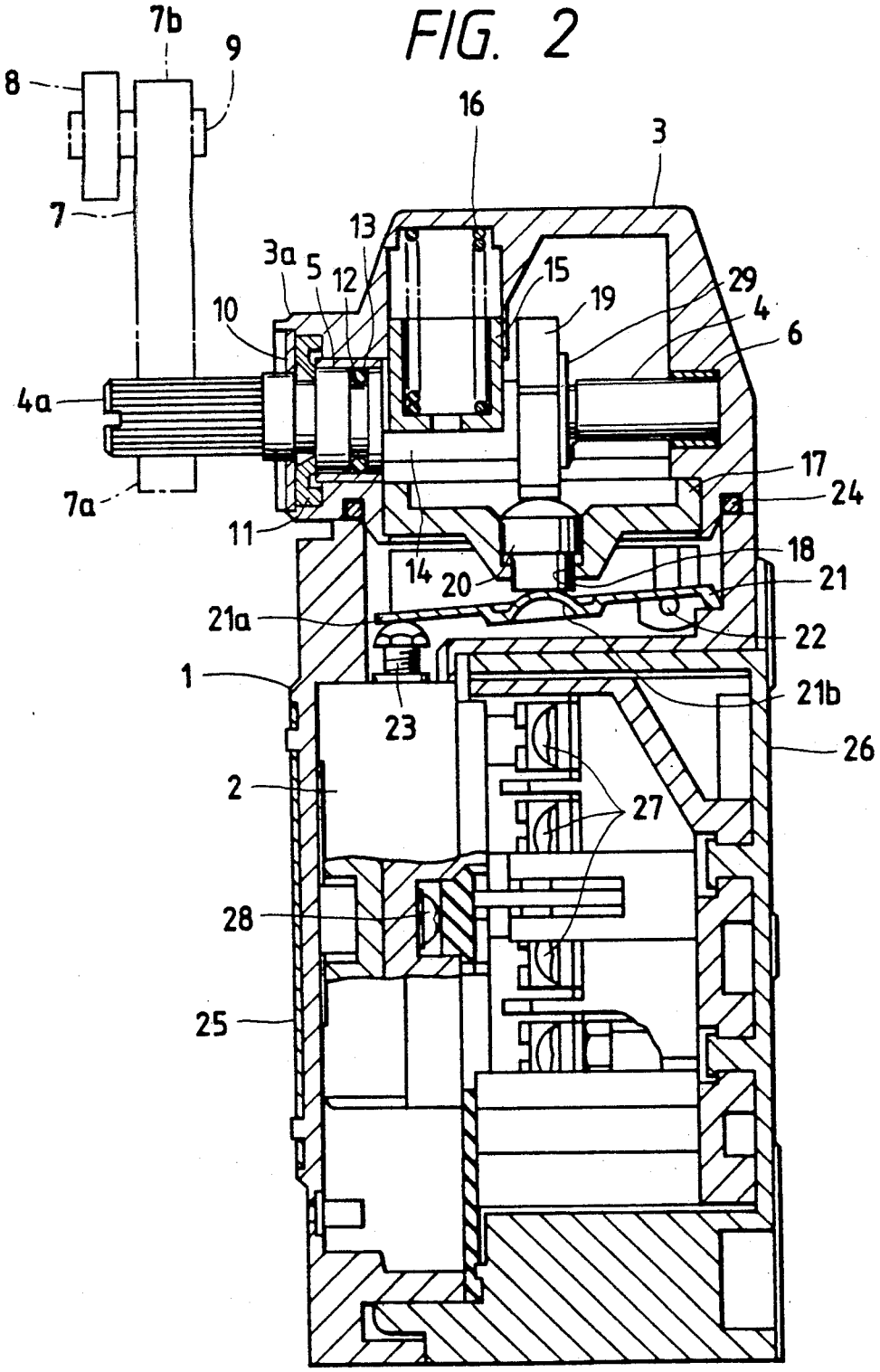
FIG. 2 is a cutaway side view of the limit switch.
Figure 12:
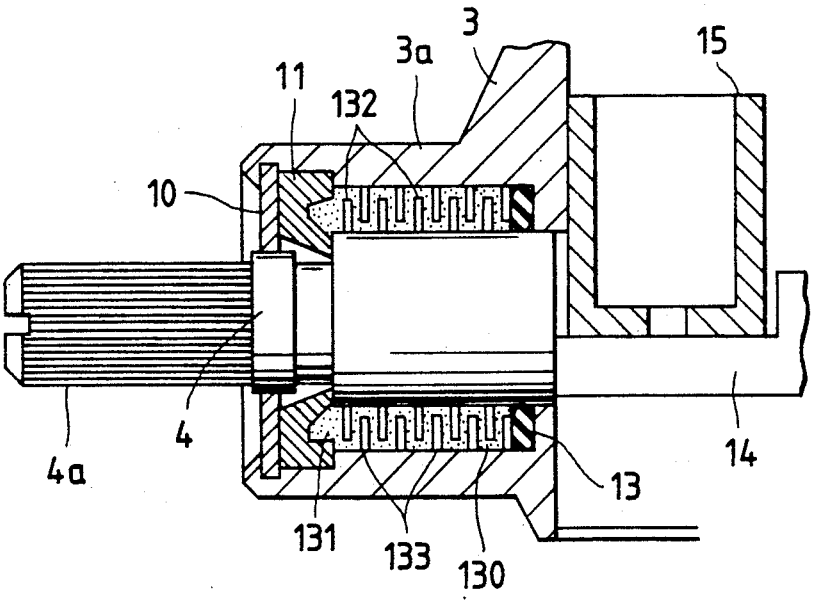
FIG. 12 is a cutaway side view of a major part of the limit switch shown in FIG. 11.
Figure 11:
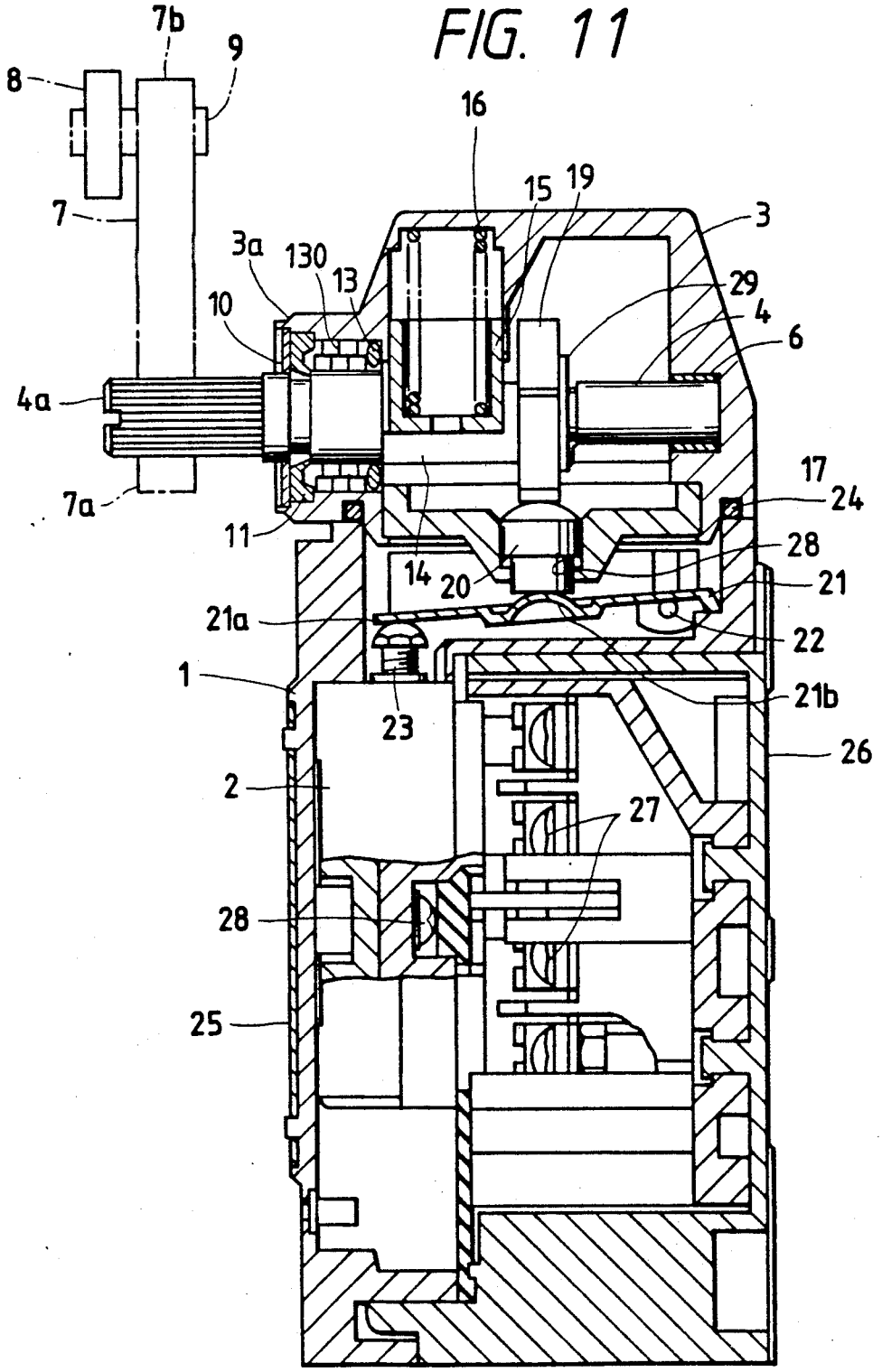
FIG. 11 is a cutaway side view of a limit switch according to yet another embodiment of the present invention.

FIG. 11 shows a limit switch is yet another embodiment. A cutaway side of the limit switch of this embodiment is similar to that shown in FIG. 2. The portions of the limit switch which correspond to those of the limit switch provided in accordance with the related art are denoted by the same reference symbols and thus are not described in detail hereinafter. A sealed space 130 is defined by the inside surface of the cylindrical portion 3*a* of the head 3 of the limit switch and the oil seal 11 and O-ring 13 thereof. As shown in FIG. 12, a viscous fluid 131 such as oil is hermetically contained in the sealed space 130. A plurality of movable plates 132 and a plurality of fixed plates 133 are alternately provided in the sealed space 130 in such a manner that the movable plates are secured to the outside circumferential surface of the rotary shaft 4 of the switch and the fixed plates are secured to the inside surface of the head 3.

The operation of the limit switch shown in FIG. 11 is described in detail from now on. The basic operation is the same as that of the operation of the limit switch provided in accordance with the related art, and is therefore not described hereinafter. Once an object which has been detected by the limit switch breaks contact with the roller 8 of the switch, the manipulation lever 7 is rotated back to the free position thereof by the force of a return coil spring 16. The inertial force is reduced by the braking action of the viscous fluid 131 and the movable and the fixed plates 132 and 133 in the sealed space 130 of the head 3 so that the lever is prevented from being rotated back beyond the free position thereof. The basic switching mechanism 2 of the limit switch is thus prevented from chattering and the like.

Figure 13:
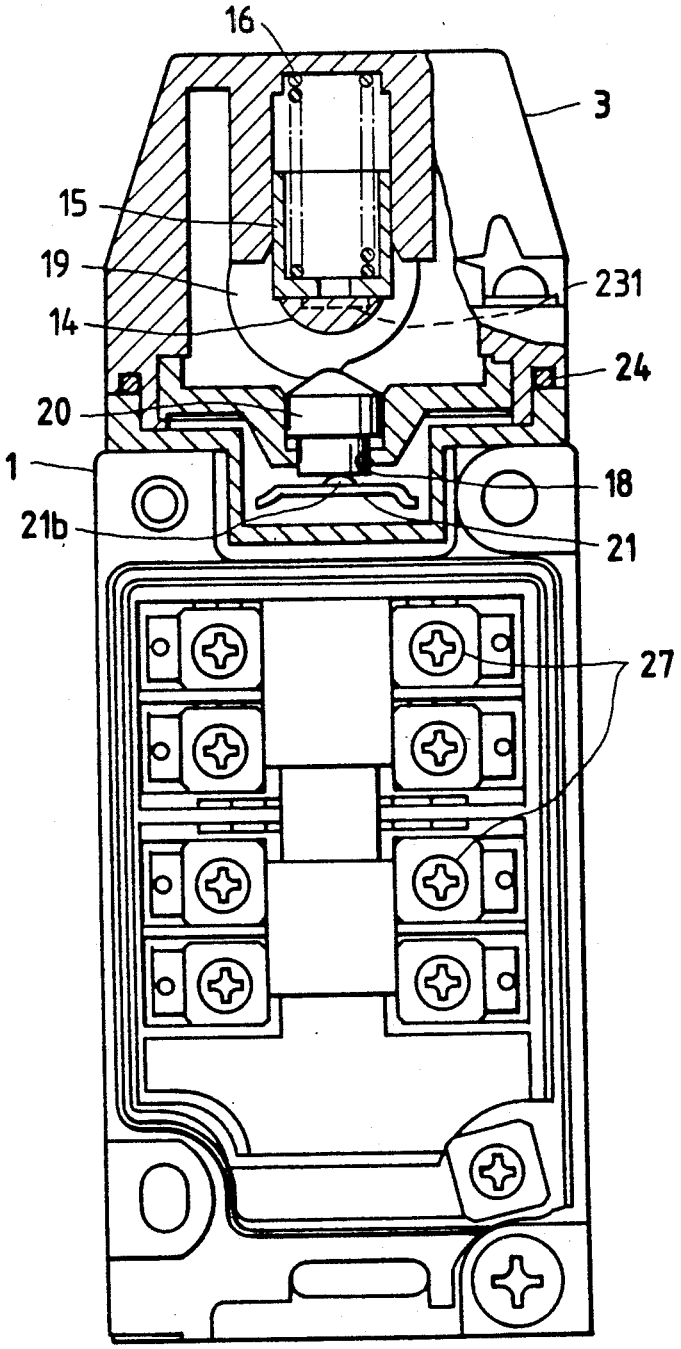
FIG. 13 is a cutaway front view of a limit switch which is yet another embodiment of the present invention.
Figure 14:
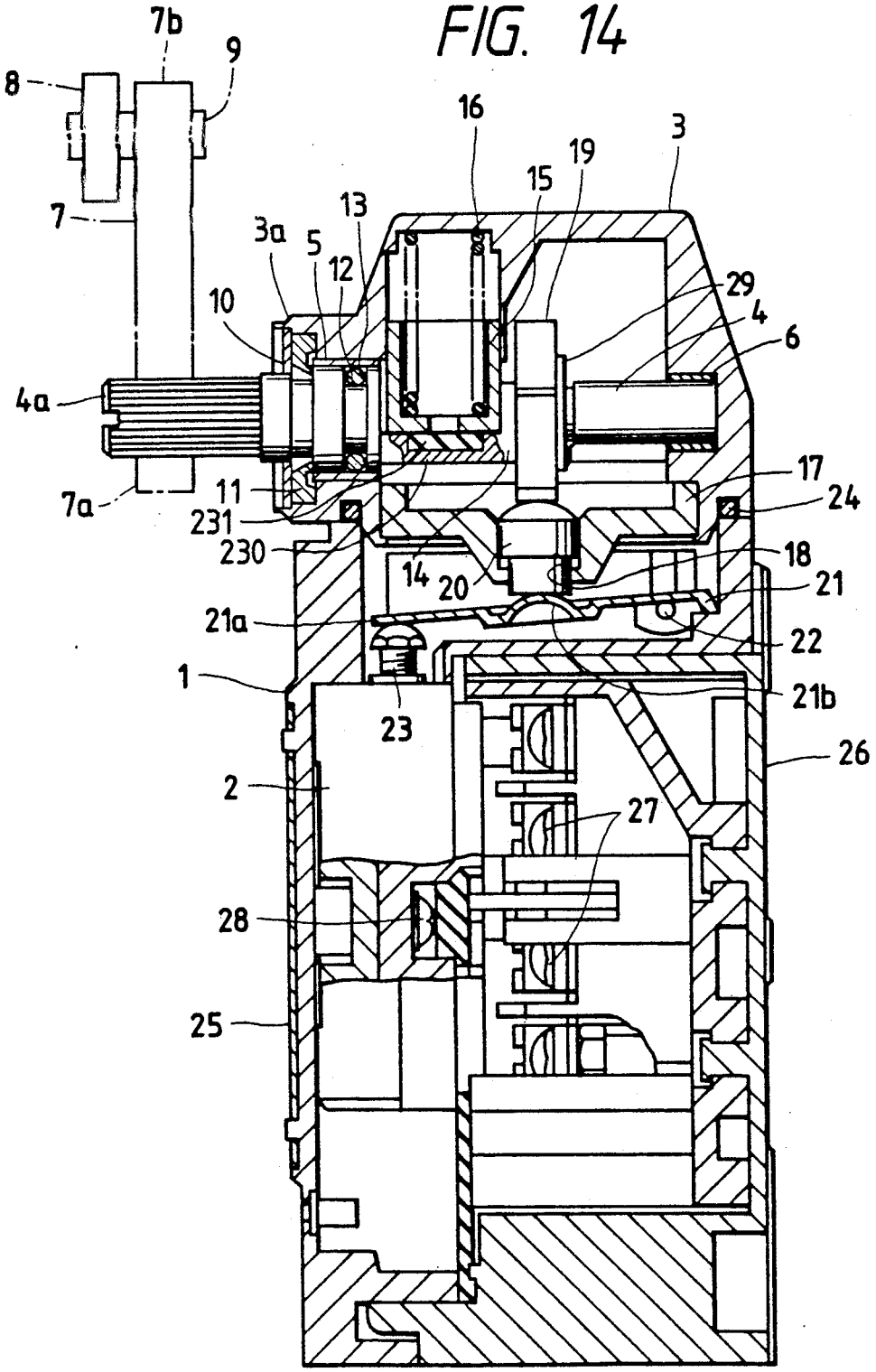
FIG. 14 is a cutaway side view of the limit switch shown in FIG. 13.
Figure 15:
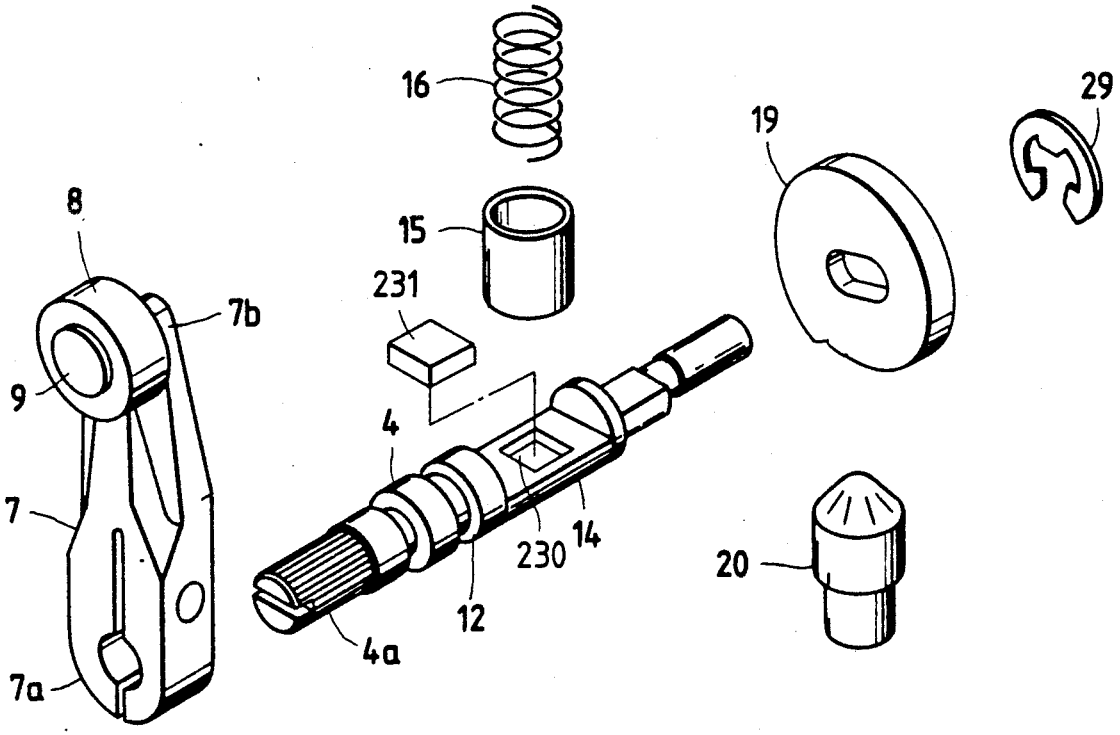
FIG. 15 is a perspective exploded view of a major part of the limit switch shown in FIG. 13.

FIGS. 13 and 14 show a limit switch which is yet another embodiment. The portions of the limit switch which correspond to those of the limit switch provided in accordance with the related art are denoted by the same reference symbols and thus are not described in detail hereinafter. The top of the flat portion 14 of the rotary shaft 4 of the limit switch shown in FIGS. 13 and 14 has a recess 230 as shown in FIG. 15. A return plunger 15 provided over the top of the flat portion 14 of the rotary shaft 4. An elastic plate 231 such as a rubber plate is fixed in the recess 230 by sticking or the like so that the elastic plate absorbs impact the of return plunger 15 on the flat portion 14 of the rotary shaft 4 when the manipulation lever 7 of the limit switch is rotated back to the free position thereof.

Figure 16:
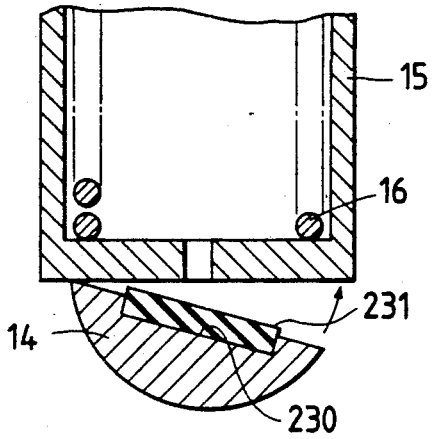
FIG. 16 is a view for explaining the operation of a major part of the limit switch shown in FIG. 13.

The operation of the limit switch shown in FIGS. 13 and 14 is described in detail from now on. The basic operation is the same as that of the operation of the limit switch provided in accordance with the related art, and is therefore not described in detail hereinafter. Once an object which has been detected by the limit switch breaks contact with the roller 8 of the switch, the manipulation lever 7 is rotated back to the free position by the force of the return coil spring 16. The top of the flat portion 14 of the rotary shaft 4 and the return plunger 15 could collide with each other due to the inertial force of the manipulation lever. However, the return plunger 15 does not collide with the flat portion 14 of the rotary shaft 4 but with the elastic plate 231, as shown in FIG. 16. Therefore the impact of the plunger on the rotary shaft is absorbed. Since the inertial force of the lever 7 is absorbed, the lever is prevented from being rotated back beyond the free position. The basic switching mechanism 2 of the limit switch is thus prevented from chattering and the like. Also, since the impact is absorbed by the elastic plate 231 fixed in the flat portion 14 of the rotary shaft 4, the flat portion is not worm at the edges thereof by the return plunger 15.

Figure 17:
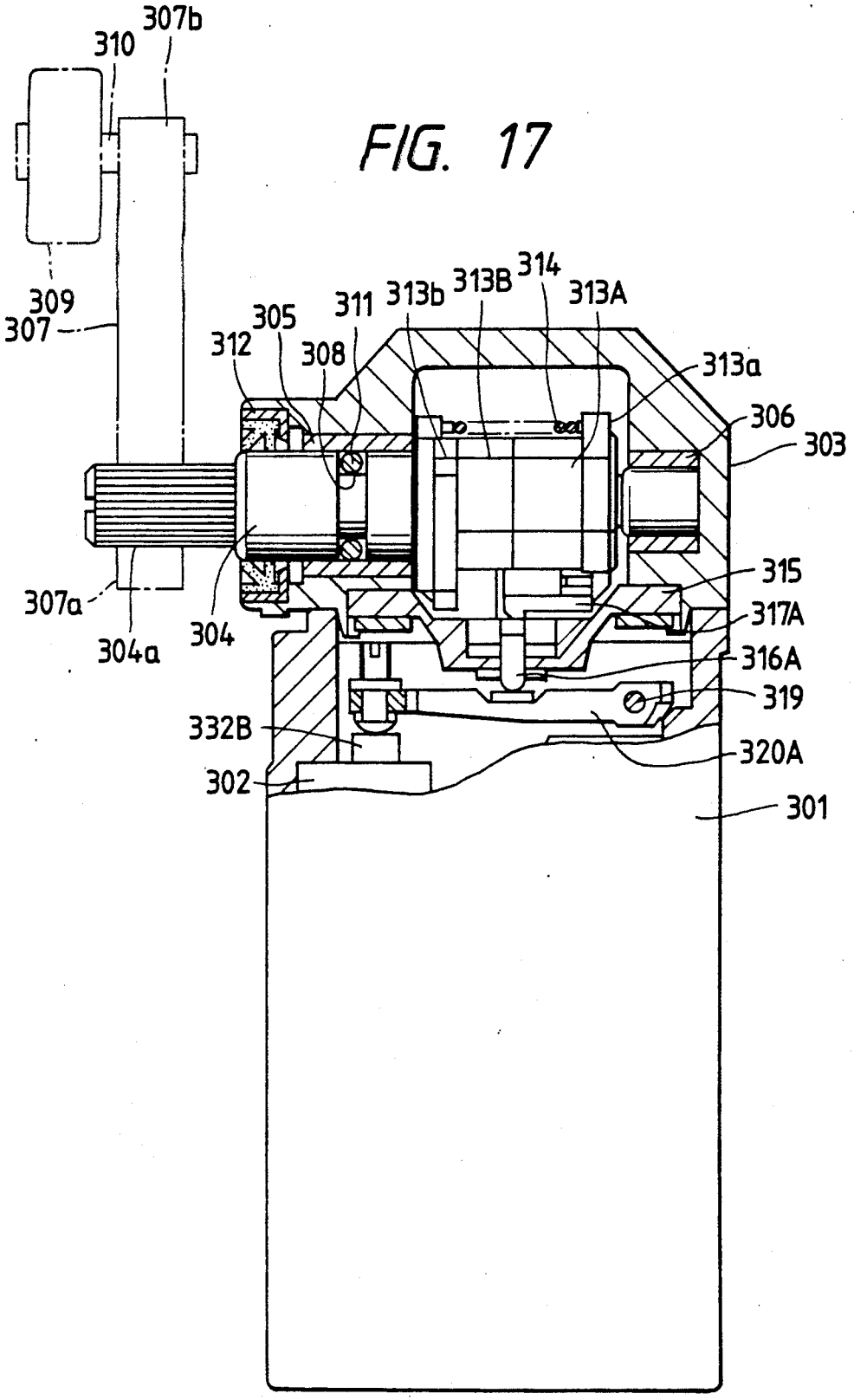
FIG. 17 is a cutaway side view of a limit switch which is yet another embodiment of the present invention.
Figure 18:
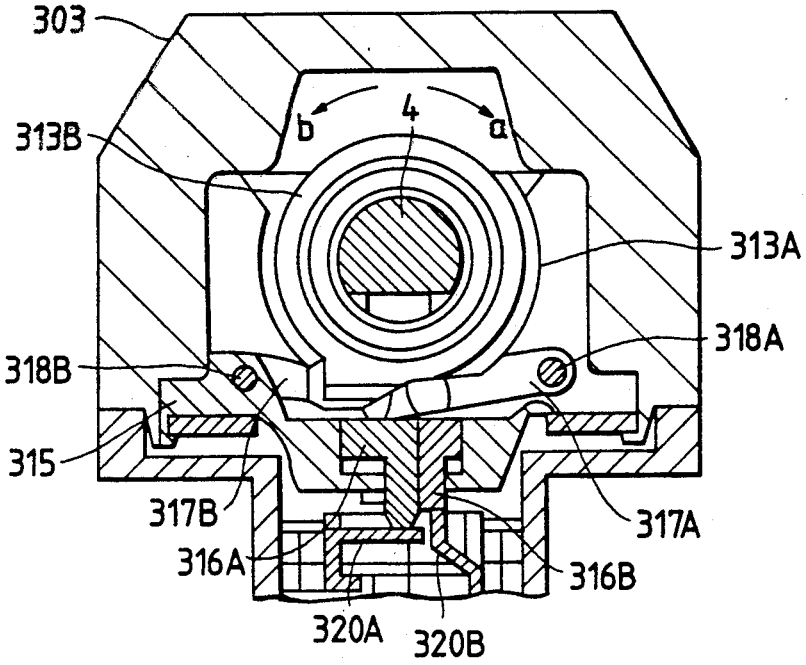
FIG. 18 is a cutaway front view of the head of the limit switching shown in FIG. 17.
Figure 20:
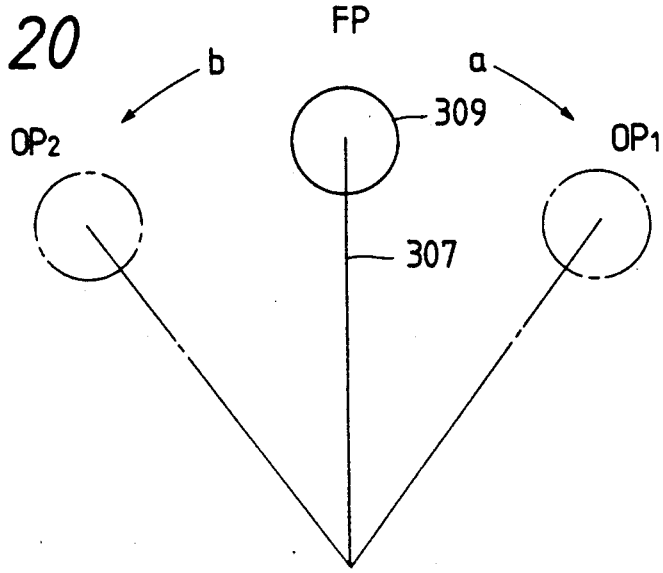
FIG. 20 is a view showing the direction of the motion of the manipulation lever of the limit switch shown in FIG. 17.

FIG. 17 shows a limit switch which is yet another embodiment. The limit switch includes a case 301 housing a basic switching mechanism 302, a head 303 secured to the upper end of the case, and a rotary shaft 304 supported by bearings 305 and 306 in the head. The butt 307*a* of the manipulation lever 307 of the limit switch is secured to the rotary shaft 304 at the outer end 304*a* thereof. The outside circumferential surface of the rotary shaft 304 has an annular groove 308. A roller 309, with which a detected object such as a workpiece comes into contact, is rotatably supported with a shaft 310 at the tip 307*b* of the manipulation lever 307. An O-ring 311 is fitted in the annular groove 308. An oil seal 312 is provided between the head 303 and the rotary shaft 304. A first cam 313A and a second cam 313B are secured side by side to the rotary shaft 304. The surface 313*a* of the first cam 313A is set for clockwise rotation shown by arrows a in FIGS. 18 and 20. The surface 313*b* of the second cam 313B is set for counterclockwise rotation shown by arrows b in FIGS. 18 and 20. A spring 314 is engaged around the first and the second cams 313A and 313B so as to apply a returning force to the manipulation lever 307 through the cams. As shown in FIG. 18, a first plunger 316A and a second plunger 316B, which correspond to the first and the second cams 313A and 313B, are movably supported in the axial directions of the plungers by a plunger holder 315 provided at the bottom of the head 303. A first lever 317A and a second lever 317B are supported with shafts 318A and 318B by the holder 315. The first plunger 316A is driven by the first lever 317A and the first cam 313A. The second plunger 316B is driven by the second lever 317B and the second cam 313B. A first drive lever 320A and a second drive lever 320B are supported by a shaft 319 in the case 301 between the basic switching mechanism 302 and the first and the second plungers 316A and 316B. The leverages of the drive levers 320A and 320B, each of which is the ratio of the length from the fulcrum for the drive lever to the point of application of force to the drive lever to the length from the fulcrum to the point of application of force to the drive lever, are set so that the basic switching mechanism 302 is turned on or off through the motions of the plungers 316A and 316B in the axial directions thereof. The drive levers counteract the driving actions of the plungers when the manipulation lever 307 is on the verge of being rotated back beyond the free position thereof, which is shown by a reference symbol FP in FIG. 20.

Figure 19:
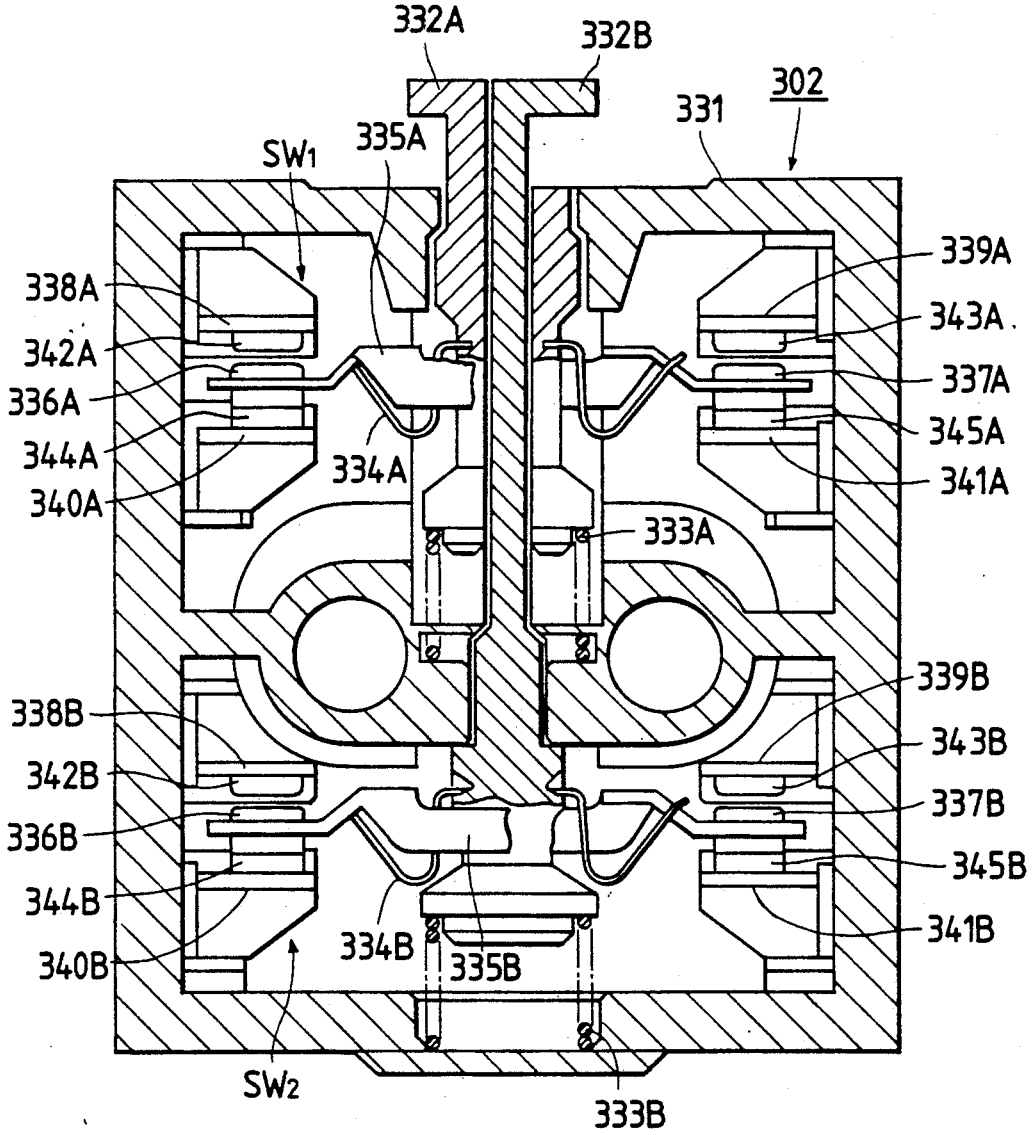
FIG. 19 is a sectional view of the basic switching mechanism of the limit switch shown in FIG. 17.

FIG. 19 shows the basic switching mechanism 302 of the limit switch shown in FIG. 17. The mechanism 302 includes an upper switching unit $SW_1$ and a lower switching unit $SW_2$ provided in the casing 331 of the mechanism, and a first manipulation rod 332A and a second manipulation rod 332B supported concentrically to each other with return springs 333A and 333B in the casing so that the rods are movable up an down. When the manipulation lever 307 is rotated clockwise with regard to FIG. 20, the first manipulation rod 332A is pushed in by the first drive lever 320A. When the manipulation lever 307 is rotated counterclockwise with regard to FIG. 20, the first manipulation rod 332A is pushed in by the first drive lever 320A. When the manipulation lever 307 is rotated counterclockwise with regard to FIG. 20, the second manipulation rod 332B is pushed in by the second drive lever 320B. A First movable spring 334A and a second movable spring 334B, each of which is generally W-shaped, are engaged with the first and the second manipulation rods 332 A and 332B, respectively. A first movable member 335A and a second movable member 335B are driven by the first and the second manipulation rods 332A and 332B through the actions of both the ends of the first and the second movable springs 334A and 334B, respectively. Movable contacts 336A and 337A are secured to the first movable member 335A at both the ends thereof. Movable contacts 336B and 337B are secured to the second movable member 335B at both the ends thereof. A pair of fixed terminals 338A and 339A and another pair of fixed terminals 340A and 341A are secured to the upper portion of the casing 331. Normally-open fixed contacts 342A and 343A are secured to the fixed terminals 338A and 339A and face the movable contacts 336A and 337A, respectively. Normally-closed fixed contacts 344A and 345A are secured to the other fixed terminals 340A and 341A and face the movable contacts 336A and 337A, respectively. A pair of fixed terminals 338B and 339B and another pair of fixed terminals 340B and 341B are secured to the lower portion of the casing 331. Normally-open fixed contacts 342B and 343B are secured to the fixed terminals 338B and 339B and face the movable contacts 336B and 337B, respectively. Normally-closed fixed contacts 344B and 345B are secured to the other fixed terminals 340B and 341B and face the movable contacts 336B and 337B, respectively.

Figure 21A:
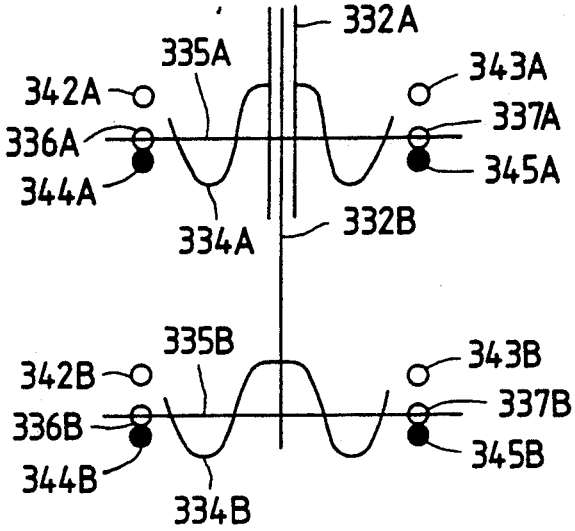
FIG. 21*a* is a view showing the state of the basic switching mechanism, which corresponds to the neutral free position of a manipulation lever.
Figure 21B:
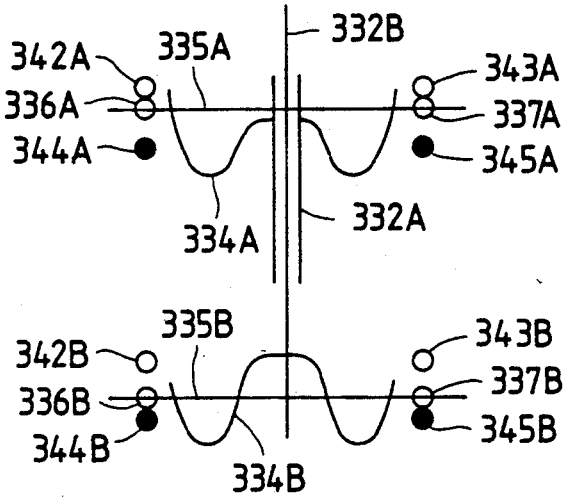
FIG. 21*b* is a view showing the state of the basic switching mechanism, which corresponds to the clockwise rotated position of the manipulation lever.
Figure 21C:
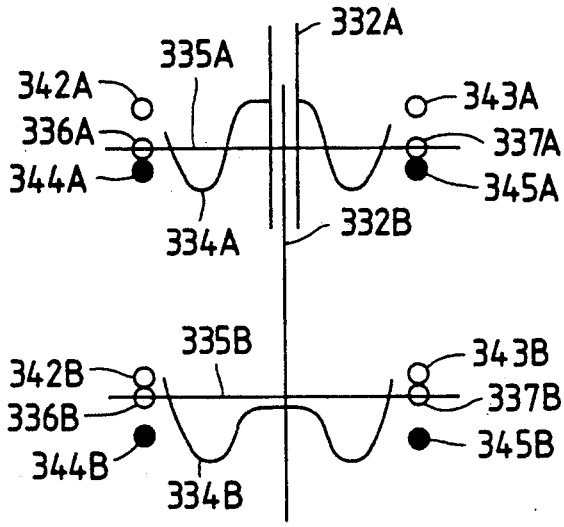
FIG. 21*c* is a view showing the state of the basic switching mechanism, which corresponds to the counterclockwise rotated position of the manipulation lever.

The operation of the limit switch shown in FIG. 17 in now described in detail. When the manipulation lever 307 is in the neutral free position FP shown in FIG. 20, the first and the second manipulation rods 332A and 332B of the basic switching mechanism 302 are not pushed in, so that the first and the second switching units $SW_1$ and $SW_2$ are in states shown in FIG. 21*a*. When the detected object has come into contact with the roller 309 so that the manipulation lever 307 is rotated clockwise with regard to FIG. 20, the first and the second cams 313A and 313B are turned by the rotary shaft 304 against the force of the return spring 314. At that time, the first lever 317A is rotated by the surface 313*a* of the first cam 313A so that the first plunger 316A is moved down in the axial direction thereof. Because of the downward movement of the plunger 316A, the first manipulation rod 332A of the basic switching mechanism 2 is pushed in through the action of the drive lever 320A. When the manipulation lever 307 is rotated further clockwise to an operative position $OP_1$ shown in FIG. 20, the first movable spring 334A is inverted due to the displacement of the first manipulation rod 332A so that the first movable member 335A is moved up. As a result, the movable contacts 336A and 337A come into contact with the normally-open fixed contacts 342A and 343A, respectively, as shown in FIG. 21*b*. When the detected object breaks contact with the roller 309, the manipulation lever 307 is rotated back to the neutral free position FP by the force of the return spring 314. At that time, the first manipulation rod 332A of the basic switching mechanism 302 is returned to the original position thereof by the force of the return spring 333A, the movable member 335A is moved back to the original position thereof through the action of the movable spring 334A, and the movable contacts 336A and 337A come into contact with the normally-closed fixed contacts 344A and 345A, respectively. When the manipulation lever 307 is rotated counterclockwise from the neutral free position FP with regard to FIG. 20, the second lever 317B is rotated by the surface 313B of the second cam 313B so that the second plunger 316B is moved down. Because of the downward movement of the second plunger 316B, the second manipulation rod 332B of the basic switching mechanism 302 is pushed in through the action of the drive lever 320B. When the manipulation lever 307 is rotated counterclockwise further to an operative position $OP_2$ shown in FIG. 20, the second movable spring 334B is inverted due to the displacement of the second manipulation rod 332B so that the second movable member 335B is moved up. As a result, the movable contacts 336B and 337B come into contact with the normally-open fixed contacts 342B and 343B, respectively, as shown in FIG. 21*c*. when the detected object then breaks contact with the roller 309, the manipulation lever 307 is rotated back to the neutral free position FP. At that time, the second manipulation rod 332B is returned to the original position thereof by the force of the return spring 333B, the movable member 335B is moved back to the original position thereof through the action of the movable spring 334B, and the movable contacts 336B and 337B come into contact with the normally-closed fixed contacts 344B and 345B, respectively.

When the manipulation lever 307 is rotated back to the neutral free position FP from the operative position OP2, for example, the lever could be rotated back beyond the neutral free position due to the force of the return spring 314. However, the leverage of the first drive lever 320A, which is the ratio of the length from shaft 319 to the point of application of force (where the first plunger 316A comes into contact with the first drive lever) over the length from shaft 319 to the point of action (where the tip of the first drive lever comes into contact with the first manipulation rod 332A) is selectively preset so that the first drive lever counteracts the driving force of the first cam 313A when the manipulation leer 307 is on the verge of being rotated back beyond the neutral free position FP thereof. For that reason, the manipulation lever 307 is prevented from being rotated back beyond the neutral free position FP thereof. The first manipulation rod 332A is thus prevented from being pushed in to unnecessarily turn on the first switching unit $SW_1$ of the basic switching mechanism 302.

The above description and the accompanying drawings are merely illustrative of the application of the principles of the present invention and are not limiting. Numerous other arrangements which employ the principles of the invention and which fall within its spirit and scope may be readily revised by those skilled in the art. Accordingly, the invention is not limited by the foregoing description, but only limited by the scope of the appended claims.

What is claimed is:

1. A limit switch comprising:

a case housing switching means having two pushed-in type manipulation rods;

said switching means comprising two switch members, whereby said first switch member is driven by said first manipulation rod and said second switch member is driven by said second manipulation rod;

two switching contacts associated with each switch member, one located on either side of the manipulation rod associated with each switch member such that the switching contacts are simultaneously switched when said manipulation rods are vertically moved;

a head secured to one end of said case;

a rotary shaft rotatably supported by said head;

a manipulation lever secured at a butt end thereof to said rotary shaft;

cam means provided on said rotary shaft for converting rotational motion into straight motion;

a return spring mounted to soil cam means for applying a returning force to said lever through said cam means and said rotary shaft to return the manipulation lever to a free position;

lever means pivotally mounted in said head and actuated by said cam means;

plunger means for switching said switching means disposed within the limit switch and driven axially in response to said lever means, and drive lever means actuated by said plunger means and disposed between said plunger means and said manipulation rod for counteracting force from said cam means to said manipulation rod before said manipulation lever is returned beyond the free position.

2. The limit switch according to claim 1 wherein the first switch member is located vertically on top of the second switch member.

3. The limit switch according to claim 1 wherein the cam means is comprised of two cam member.

4. The limit switch according to claim 1 wherein the plunger means is comprised of two plunger members.

5. The limit switch according to claim 1 wherein the drive lever means is comprised of two drive lever members.

* * * * *